US012303021B2

(12) United States Patent
Jungnickel et al.

(10) Patent No.: US 12,303,021 B2
(45) Date of Patent: May 20, 2025

(54) HEAD FOR AN ORAL CARE IMPLEMENT

(71) Applicant: Braun GmbH, Kronberg (DE)

(72) Inventors: Uwe Jungnickel, Koenigstein (DE); Marlis Hubner, Bad Soden (DE); Kathi Ballmaier, Wehrheim (DE); Soeren Wasow, Langenselbold (DE); Fiona Harrington, Bad Soden (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 18/302,957

(22) Filed: Apr. 19, 2023

(65) Prior Publication Data

US 2023/0248139 A1 Aug. 10, 2023

Related U.S. Application Data

(63) Continuation of application No. 16/910,119, filed on Jun. 24, 2020, now Pat. No. 11,641,932, which is a (Continued)

(30) Foreign Application Priority Data

Jun. 6, 2013 (EP) ..... 13170759
Jun. 6, 2013 (EP) ..... 13170761
Jun. 6, 2013 (EP) ..... 13170764

(51) Int. Cl.
*A46B 9/04* (2006.01)
*A46B 9/02* (2006.01)
(Continued)

(52) U.S. Cl.
CPC ..... *A46B 9/04* (2013.01); *A46B 9/025* (2013.01); *A46B 9/028* (2013.01); *A46B 9/06* (2013.01);
(Continued)

(58) Field of Classification Search
CPC .... A46B 9/02; A46B 9/04; A46B 9/06; A46B 9/025; A46B 9/028; A46D 1/02
See application file for complete search history.

(56) References Cited

U.S. PATENT DOCUMENTS 2,488,873 A 11/1949 Edgar
3,103,679 A 9/1963 Clemens
(Continued)

FOREIGN PATENT DOCUMENTS

AU 2003252861 A1 4/2005
CA 2808212 A1 2/2012
(Continued)

OTHER PUBLICATIONS

WO 0051462 A1; Weihrauch Georg; Publ'n Date Sep. 8, 2000.*
(Continued)

*Primary Examiner* — Randall E Chin
(74) *Attorney, Agent, or Firm* — Jay A. Krebs

(57) ABSTRACT

A head for an oral care implement comprises a mounting surface and at least one tuft extending from the mounting surface. The tuft comprises a first group of filaments and at least a second group of filaments. The first group of filaments is surrounded by the second group of filaments. The filaments of the first group have a first length and the filaments of the second group have a second length, the first length being different from the second length. The difference in length between the first length and the second length is about 1.1 mm to about 1.9 mm.

19 Claims, 5 Drawing Sheets

Related U.S. Application Data continuation of application No. 15/985,779, filed on May 22, 2018, now Pat. No. 10,729,232, which is a continuation of application No. 14/296,681, filed on Jun. 5, 2014, now Pat. No. 10,004,322.

(51) Int. Cl.
*A46B 9/06* (2006.01)
*A46D 1/00* (2006.01)

(52) U.S. Cl.
CPC ..... *A46D 1/02* (2013.01); *A46B 2200/1066* (2013.01)

(56) References Cited

U.S. PATENT DOCUMENTS

| | | | |
|---|---|---|---|
| 5,046,213 | A | 9/1991 | Curtis et al. |
| 5,249,327 | A | 10/1993 | Hing |
| 5,325,560 | A | 7/1994 | Pavone et al. |
| 5,535,474 | A | 7/1996 | Salazar |
| 5,799,353 | A | 9/1998 | Oishi et al. |
| 5,926,897 | A | 7/1999 | Volpenhein |
| 6,363,565 | B1 | 4/2002 | Paffrath |
| 6,546,586 | B2 | 4/2003 | Cho |
| 6,726,789 | B1 | 4/2004 | Weihrauch |
| 6,993,804 | B1 | 2/2006 | Braun et al. |
| D623,415 | S | 9/2010 | Geiberger |
| 9,066,579 | B2 | 6/2015 | Hess et al. |
| 10,004,322 | B2 | 6/2018 | Jungnickel |
| 10,729,232 | B2 | 8/2020 | Jungnickel et al. |
| 11,641,932 | B2 | 5/2023 | Jungnickel et al. |
| 2002/0138926 | A1 | 10/2002 | Brown et al. |
| 2003/0178885 | A1 | 9/2003 | Weihrauch |
| 2004/0003478 | A1 | 1/2004 | Mink |
| 2005/0166344 | A1 | 8/2005 | Hohlbein et al. |
| 2006/0037161 | A1 | 2/2006 | Okada et al. |
| 2006/0186725 | A1 | 8/2006 | Weihrauch |
| 2009/0013489 | A1 | 1/2009 | Binet |
| 2009/0064435 | A1 | 3/2009 | Fukugaki et al. |
| 2010/0101038 | A1 | 4/2010 | Garbers et al. |
| 2010/0115724 | A1 | 5/2010 | Huang |
| 2010/0223745 | A1 | 9/2010 | Kraemer et al. |
| 2011/0030160 | A1 | 2/2011 | Knutzen et al. |
| 2011/0214240 | A1 | 9/2011 | Jimenez |
| 2013/0139338 | A1 | 6/2013 | Hess et al. |
| 2013/0139339 | A1 | 6/2013 | Hess et al. |
| 2013/0255017 | A1 | 10/2013 | Lee |
| 2020/0323335 | A1 | 10/2020 | Jungnickel et al. |

FOREIGN PATENT DOCUMENTS

| | | | | | |
|---|---|---|---|---|---|
| CN | 101433400 | A | | 5/2009 | |
| DE | 3528596 | A1 | | 2/1987 | |
| DE | 29600139 | U1 | | 2/1996 | |
| DE | 19931156 | A1 | | 1/2001 | |
| DE | 20213083 | U1 | | 10/2002 | |
| DE | 19832436 | B4 | | 9/2008 | |
| DE | 202008016004 | U1 | | 2/2009 | |
| DE | 102010014928 | A1 | | 10/2011 | |
| DE | 102010014929 | A1 | | 10/2011 | |
| EP | 0716821 | A1 | | 6/1996 | |
| EP | 1240847 | A2 | | 9/2002 | |
| EP | 0955837 | B1 | | 2/2003 | |
| EP | 1588673 | A2 | | 10/2005 | |
| EP | 2213260 | A2 | | 8/2010 | |
| EP | 2543277 | A1 | | 1/2013 | |
| EP | 2543278 | A2 | | 1/2013 | |
| GB | 1311974 | A | | 3/1973 | |
| JP | 2001218623 | A | | 8/2001 | |
| JP | 2002345554 | A | | 12/2002 | |
| JP | 2012245314 | A | | 12/2012 | |
| JP | 2013052110 | A | | 3/2013 | |
| JP | 2017014668 | A | | 1/2017 | |
| KR | 100743809 | B1 | | 7/2007 | |
| KR | 10-2012-0006490 | A | * | 1/2012 | |
| WO | 9923910 | A1 | | 5/1999 | |
| WO | WO-0051462 | A1 | * | 9/2000 | ..... A46D 1/08 |
| WO | 2004080237 | A1 | | 9/2004 | |
| WO | 2007134026 | A1 | | 11/2007 | |
| WO | 2009000903 | A1 | | 12/2008 | |
| WO | 2010069917 | A1 | | 6/2010 | |
| WO | 2010069919 | A1 | | 6/2010 | |
| WO | 2012022431 | A1 | | 2/2012 | |
| WO | 2013133848 | A1 | | 9/2013 | |

OTHER PUBLICATIONS

All Office Actions, U.S. Appl. No. 16/910,119, filed Jun. 24, 2020.
All Office Actions; U.S. Appl. No. 14/296,681, filed Jun. 5, 2014.
All Office Actions; U.S. Appl. No. 15/985,779, filed May 22, 2018.
Extended EP Search Report and Written Opinion for 14164382.5 dated Jun. 18, 2014, 5 Pages.
Third Party Opposition for Application Serial No. EP14164382.5 dated May 23, 2018, 9 Pages.
PCT Search Report and Written Opinion for PCT/US2014/041054 dated Oct. 20, 2014, 9 Pages.

* cited by examiner

HEAD FOR AN ORAL CARE IMPLEMENT

FIELD OF THE INVENTION

The present disclosure is concerned with a head for an oral care implement and in particular with such a head comprising at least one tuft having filaments of different lengths.

BACKGROUND OF THE INVENTION

Tufts composed of a plurality of filaments for oral care implements, like manual and powered toothbrushes are well known in the art. Generally, the tufts are attached to a mounting surface of a head intended for insertion into a user's oral cavity. A grip handle is usually attached to the head, which handle is held by the user during brushing. The head is either permanently connected or repeatedly attachable to and detachable from the handle.

It is known that filaments forming one tuft often have substantially the same dimensions and characteristics. While toothbrushes comprising these types of tufts clean the outer buccal face of teeth adequately, they are not as well suited to provide adequate removal of plaque and debris from the gingival margin, interproximal areas, lingual surfaces and other hard to reach areas of the mouth.

Tufts composed of two different types of filaments, so called tuft-in-tufts, are also known in the art. In general, each type of filament is arranged in a group, wherein an inner group is substantially coaxially enclosed by an outer group to form the tuft. For example, a toothbrush head is known having a bristle surface from which tufts comprising plural filaments extend in a filament direction. Each tuft comprises shorter filaments having a cross section which does not taper from their lower end towards their upper end and longer filaments which taper from their lower end towards their upper end.

The tuft-in-tufts known in the art, in particular the longer filaments located in the central region of the tuft, show substantially poor interdental cleaning properties.

It is an object of the present disclosure to provide a head for an oral care implement which provides improved cleaning properties, in particular with respect to interproximal and gingival marginal regions of teeth. It is also an object of the present disclosure to provide an oral care implement comprising such head.

SUMMARY OF THE INVENTION

In accordance with one aspect, a head for an oral care implement is provided that comprises:

a mounting surface, and at least one tuft extending from the mounting surface, the tuft comprising a first group of filaments and at least a second group of filaments, the first group of filaments being surrounded by the second group of filaments, the filaments of the first group having a first length and the filaments of the second group having a second length, the first length being different from the second length, wherein the difference in length between the first length and the second length is about 1.1 mm to about 1.9 mm.

In accordance with one aspect, an oral care implement is provided that comprises such head.

BRIEF DESCRIPTION OF THE DRAWINGS

The invention is described in more detail below with reference to various embodiments and figures, wherein.

DETAILED DESCRIPTION OF THE INVENTION

Figure 1:
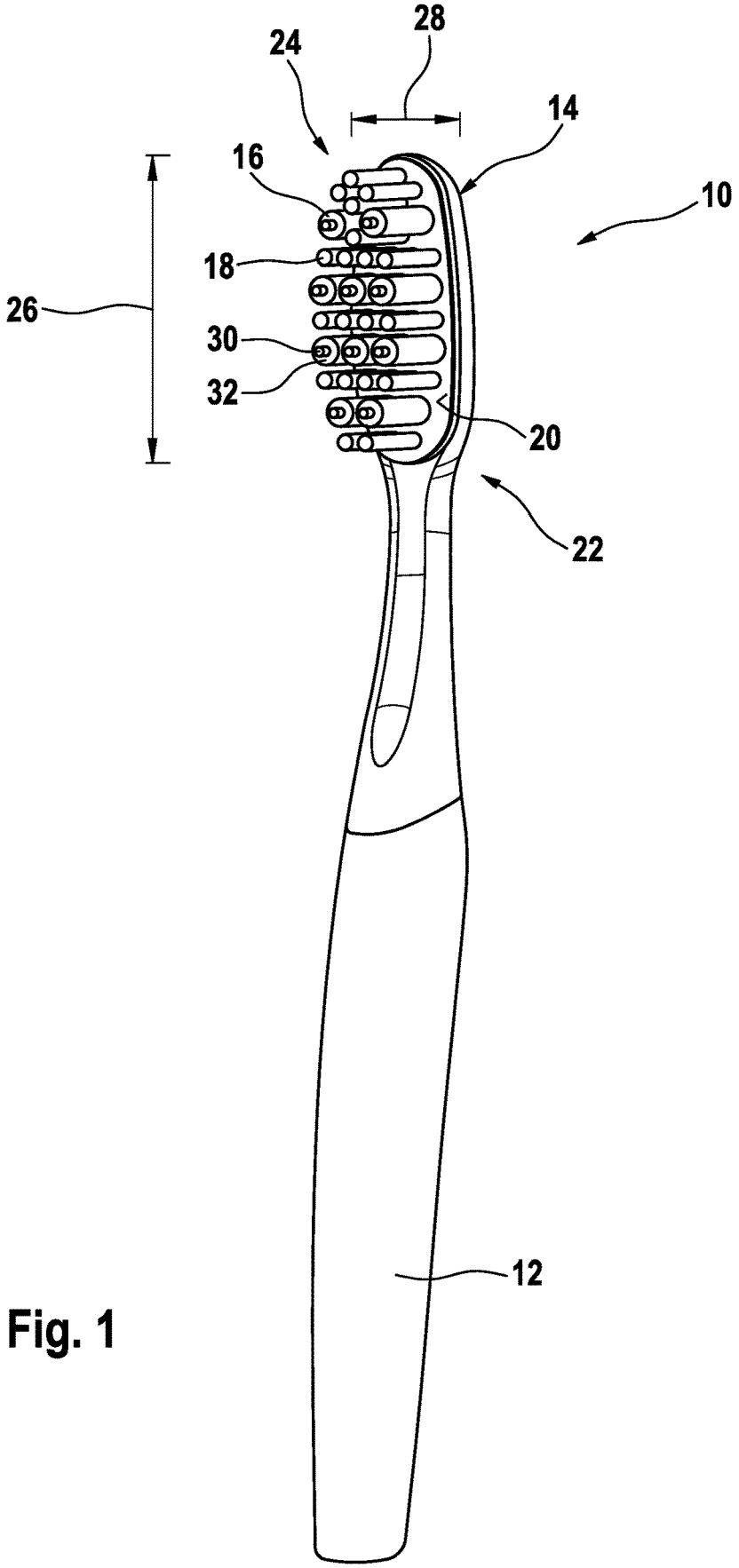
FIG. 1 shows a perspective view of an example embodiment of an oral care implement.

A head for an oral care implement in accordance with the present disclosure comprises at least one tuft which extends from a mounting surface of the head. The tuft comprises a first group of filaments having a first length and a second group of filaments having a second length which is different to the first length. In the context of this disclosure, the length of a filament is defined by the extension of the filament measured from its lower end being secured at the mounting surface of the head to its upper free/loose end. The first group of filaments is surrounded, optionally coaxially surrounded, by the second group of filaments.

In other words, the tuft is composed of two types of separated/single or isolated filaments which differ in terms of length and which are arranged in respective groups. In the context of this disclosure, a "group of filaments" means at least 5 single filaments having substantially the same length. In some embodiments, the group of filaments having the shorter length comprises at least three times the number of filaments of the other group having the greater length.

The difference in length between the first and the second length is about 1.1 mm to about 1.9 mm, optionally from about 1.3 mm to about 1.7 mm, further optionally about 1.5 mm. Such difference in length may allow good penetration of the greater filaments into interdental spaces whereas the shorter filaments may clean the buccal, lingual and occlusal surfaces of the teeth adequately. A head for an oral care implement is provided that may remove plaque and other residues more effectively both, on substantially flat surfaces as well as in interdental spaces. The group of longer filaments and the group of shorter filaments work synergistically together. Test results revealed that the difference in length between the longer and the shorter group of filaments is critical for interdental penetration and the overall cleaning capabilities. In case the length difference is too small the longer tufts may not penetrate deeply enough into the interproximal areas to provide sufficient plaque removal. However, a length difference being too large may prevent the shorter filaments from touching and cleaning the buccal, lingual and occlusal surfaces of the teeth.

Surprisingly it was found out that a length difference of about 1.5 mm provides both, improved interdental cleaning properties by means of the longer filaments and good cleaning performance on the buccal, lingual and occlusal surfaces of the teeth by means of the shorter filaments. A tuft consisting of filaments with substantially no difference in length showed substantially no interdental penetration of any filaments. A length difference below 1 mm provided poor interdental cleaning performance whereas a length difference of about 2.5 mm showed that the shorter filaments were substantially not in contact with the buccal, lingual and occlusal surfaces of the teeth.

In some embodiments, the length of the shorter filaments measured from the mounting surface to their upper free ends may be from about 8 mm to about 12 mm, optionally about 11 mm.

In some embodiments, the first length of the filaments of the first group may be longer than the second length of the filaments of the second group. In other words, longer filaments are surrounded by shorter filaments. Thus, the longer filaments may be supported by the shorter filaments which may provide the longer filaments with more stability which may result in better cleaning capabilities. In case a force is applied to the tuft, the group of shorter filaments may act as a counterforce for the group of longer filaments resulting in a higher bending stiffness of the group of longer filaments. In other words, the second group of shorter filaments may act as a support structure for the first group of longer filaments. Thus, regular or thin filaments can be used in an interior part of the tuft in order to access and clean narrow interdental spaces with sufficient contact pressure during a brushing process.

Each filament of the tuft has a longitudinal axis and a cross-sectional area extending in a plane which is perpendicular to the longitudinal axis. In some embodiments, the cross sectional area may have a substantially circular shape, and the filaments of the first group having the longer length may have a diameter being smaller than the diameter of the filaments of the second group. A relatively small diameter of said longer filaments may further facilitate said filaments to penetrate into interdental spaces and other hard to reach areas. Since the shorter filaments of the second group having the larger diameter have a higher bending stiffness compared to filaments with a smaller diameter, the second group of filaments may provide a relatively high counterforce to the filaments of the first group. Thus, the second group of shorter filaments may provide the longer filaments of the first group with increased stability and higher bending stiffness during a brushing process. The increased stability/bending stiffness may allow the longer filaments to transmit sufficient contact pressure to clean the teeth effectively and to force the filaments to penetrate into interproximal areas. In addition, the relatively long and thin filaments may provide a gentle cleaning action substantially without causing a stinging sensation/unpleasant feeling on the gums during brushing. A head for an oral care implement is provided which may provide both, good interdental penetration and cleaning properties of the longer filaments due to sufficient stability/bending stiffness and a gentle cleaning effect substantially without a pricking sensation while the shorter filaments clean the buccal, lingual and occlusal surfaces of the teeth adequately.

For example, the diameter of the filaments of the first group having the longer length may be about 0.15 mm to about 0.16 mm, optionally about 0.1524 mm (6 mil) and the diameter of the filaments of the second group having the shorter length may be about 0.17 mm to about 0.18 mm, optionally about 0.1778 mm (7 mil).

Each group of filaments and the overall tuft may have a longitudinal axis and a cross-sectional area extending in a plane perpendicular to the longitudinal axis. The cross-sectional area of the first group and/or the second group may have a circular or a non-circular shape. For example, the cross-sectional shape can be ellipsoid, squared, rectangular, triangular, cross-shaped, or it can be a prolate ellipsoid with flattened long sides, even though other shapes may be considered as well. The different groups of filaments may have various cross-sections so that various shapes/cross-sections of the overall tuft may be achieved.

In some embodiments, the overall tuft may have a substantially circular cross-sectional shape with a diameter of about 2.8 mm to about 3.2 mm, optionally of about 3 mm. In addition or alternatively, the cross sectional area of the first group of filaments may have a substantially circular shape with a diameter of about 0.8 mm to about 1.2 mm, optionally of about 1 mm. Such tuft dimensions may provide both, good interdental penetration properties and effective buccal, lingual and occlusal surface cleaning.

In some embodiments, the filaments of the greater length may be tapered filaments having a pointed tip. Tapered filaments may achieve optimal penetration into areas between two teeth as well as into gingival pockets during brushing and may provide improved cleaning properties. In some embodiments, the tapered filaments may have an overall length extending above the mounting surface of about 10 mm to 16 mm, optionally of about 12.5 mm, and a tapered portion of about 5 mm to 10 mm measured from the tip of the filament. The pointed tip may be needle shaped, may comprise a split or a feathered end. The tapering portion may be produced by a chemical and/or mechanical tapering process.

In addition or alternatively, the filaments of the first group and the filaments of the second group may further differ from each other at least in one of the following characteristics: bending stiffness, material, texture, cross sectional shape, color and combinations thereof. The filaments may be crimped, notched, dimpled, flocked or may comprise a series of ribs, for example. Textured filaments may tend to enhance cleaning effects on the teeth. The filaments may have a circular or non-circular cross-section, in particular the filaments may have a diamond- or cross-shaped cross-section, a triangular or elliptical cross-section, or a cross-section that can be described as a prolate ellipsoid with flattened long sides. Further, the filaments may be flagged at their free ends or may also be hollow. The filaments may be made up from a thermoplastic elastomer material (TPE) with or without an abrasive such as kaolin clay, from nylon with or without an abrasive such as kaolin clay, from polybutylene terephtalate (PBT) with or without an abrasive such as kaolin clay or from nylon indicator material colored at the external surface. The coloring on nylon indicator material is slowly worn away as the filament is used over time to indicate the extent to which the filament is worn.

In addition or alternatively, the at least one tuft may be inclined with respect to the mounting surface of the head. In other words, the at least one tuft may be oriented at an angle $\alpha$ relative to that portion of the mounting surface of the head from which it extends. The tuft may be angled relative to an imaginary line which is tangent to or co-planar with the mounting surface of the head through which the tuft is secured to the head. The at least one tuft may be oriented at an angle $\alpha$ in a direction that is substantially parallel to the longitudinal extension of the head and/or orthogonal thereto, i.e. across the width of the head. The at least one inclined tuft may provide improved cleaning properties, in particular with respect to interdental areas, as the inclination of the tuft may facilitate that the longer filaments slide into small gaps between the teeth to clean the interdental areas, while the shorter filaments may clean the occlusal, buccal and lingual surfaces of the teeth. The filaments of greater/increased length may assure access to narrow spaces and may be able to penetrate into the gaps between teeth and remove plaque and other residues more effectively.

In some embodiments, the head may comprise at least two tufts, at least one tuft may be inclined in a direction towards a distal end of the head and at least one tuft may be inclined in a direction towards a proximal end of the head. The term "proximal end of the head" shall mean the end of the head which is proximal to a handle which may be attached to the head, whereas the term "distal end of the head" shall mean the end of the head being opposite to the proximal end of the head, i.e. the free end of the head. In other words, at least one tuft may be angled forward and at least one tuft may be angled backward with respect to the longitudinal extension of the head. As the inclination of the tuft may facilitate that the greater filaments can slide into interdental areas/spaces in the direction of inclination more easily, the head having at least two tufts which are inclined in opposite directions may improve cleaning properties when the head is moved in said opposite directions. In case the head is moved along its longitudinal extension on the teeth surface, the longer filaments of the at least two tufts may be forced to penetrate into the interdental spaces in a forward and backward brushing motion, respectively.

In some embodiments, the head may comprise at least two rows of tufts, optionally at least three rows of tufts, each row may be arranged substantially along the longitudinal extension of the head and the tufts of each row may be inclined and aligned substantially towards the same direction. The tufts may be inclined in a direction parallel to the longitudinal extension of the head, i.e. along the length of the head, orthogonal thereto, i.e. across the width of the head, or part way between the length and the width of the head. Such tuft arrangement may even further improve the cleaning efficiency of the head.

In some embodiments the tufts of at least a first row may be inclined in a direction towards a proximal end of the head and the tufts of at least a second row may be inclined in a direction towards a distal end of the head. Optionally, at least two rows may be arranged in an alternating manner, thereby describing a so-called criss-cross tuft pattern in a side perspective view of the head. Such tuft pattern may further improve cleaning properties. When the head of an oral care implement is moved in a forward motion along its longitudinal extension, the group of longer filaments being inclined in the direction towards the distal end of the head may perform a poke, pivot and slide motion thereby penetrating into interproximal areas from a forward direction. When the head is moved in a backward motion, i.e. in the opposite direction of the forward motion, the group of longer filaments being inclined in the direction towards the proximal end of the head may perform the poke, pivot and slide motion thereby penetrating into interproximal areas from the backward direction. Thus, a criss-cross tuft pattern may allow that the groups of longer filaments penetrate into interproximal areas with every single forward and backward brushing stroke along the occlusal, buccal and lingual surfaces of the teeth.

Optionally, a distance/spacing between the tufts within one row may be adapted/correspond to the width of the teeth. This may allow synchronized penetration of the longer filaments into multiple interproximal areas/interdental spaces. Due to the fact that the width of the teeth may vary with the position of the jaws and from one person to the other, a distance/spacing between the tufts within a row may be in the range from about 3 mm to about 6 mm.

The angle $\alpha$ between the tuft and the mounting surface of the head—in the following also referred to as "inclination angle"—may be from about 45° to about 89°, optionally from about 60° to about 85°, further optionally from about 65° to about 83°, even further optionally from about 70° to about 80°, even further optionally from about 72° to about 78°, even further optionally about 74°, about 75° or about 76°.

Experiments revealed that filaments having an inclination angle $\alpha$ from about 65° to about 80°, optionally from about 70° to about 80° are more likely to penetrate into interdental gaps. Filaments having an inclination angle $\alpha$ of more than about 80° showed low likelihood of interdental penetration as these filaments bend away from the direction of travel or skip over the teeth.

In some embodiments the inclination angle $\alpha$ may be from about 74° to about 76°, optionally about 74° or about 75°. Surprisingly, it was found, that filaments having an inclination angle $\alpha$ from about 74° to about 76°, optionally about 74° or about 75° may further improve cleaning performance of the head for an oral care implement. Experiments revealed that such filaments were even more likely to penetrate into interdental gaps.

In some embodiments, the tuft may be attached to the head by means of a hot tufting process. One method of manufacturing the oral care implement may comprise the following steps: In a first step, tufts may be formed by providing a desired amount of filaments. In a second step, the tufts may be placed into a mold cavity so that ends of the filaments which are supposed to be attached to the head extend into said cavity. The opposite ends of the filaments not extending into said cavity may be either end-rounded or non-end-rounded. For example, the filaments may be not end-rounded in case the filaments are tapered filaments having a pointed tip. In a third step the head or an oral care implement body comprising the head and the handle may be formed around the ends of the filaments extending into the mold cavity by an injection molding process, thereby anchoring the tufts in the head. Alternatively, the tufts may be anchored by forming a first part of the head—a so called "sealplate"—around the ends of the filaments extending into the mold cavity by an injection molding process before the remaining part of the oral care implement is formed. Before starting the injection molding process the ends of the tufts extending into the mold cavity may be optionally melted or fusion-bonded to join the filaments together in a fused mass or ball so that the fused masses or balls are located within the cavity. The tufts may be held in the mold cavity by a mold bar having blind holes that correspond to the desired position of the tufts on the finished head of the oral care implement. In other words, the tufts attached to the head by means of a hot tufting process may be not doubled over a middle portion along their length and may be not mounted in the head by using an anchor/staple. The tufts may be mounted on the head by means of an anchor free tufting process.

The oral care implement may be a toothbrush comprising a handle and a head according to any of the embodiments described above. The head extends from the handle and may be either repeatedly attachable to and detachable from the handle or the head may be non-detachably connected to the handle. The toothbrush may be an electrical or a manual toothbrush.

The following is a non-limiting discussion of an example embodiment of an oral care implement comprising an example embodiment of a tuft in accordance with the present disclosure, where reference to the Figures is made.

Figure 2:
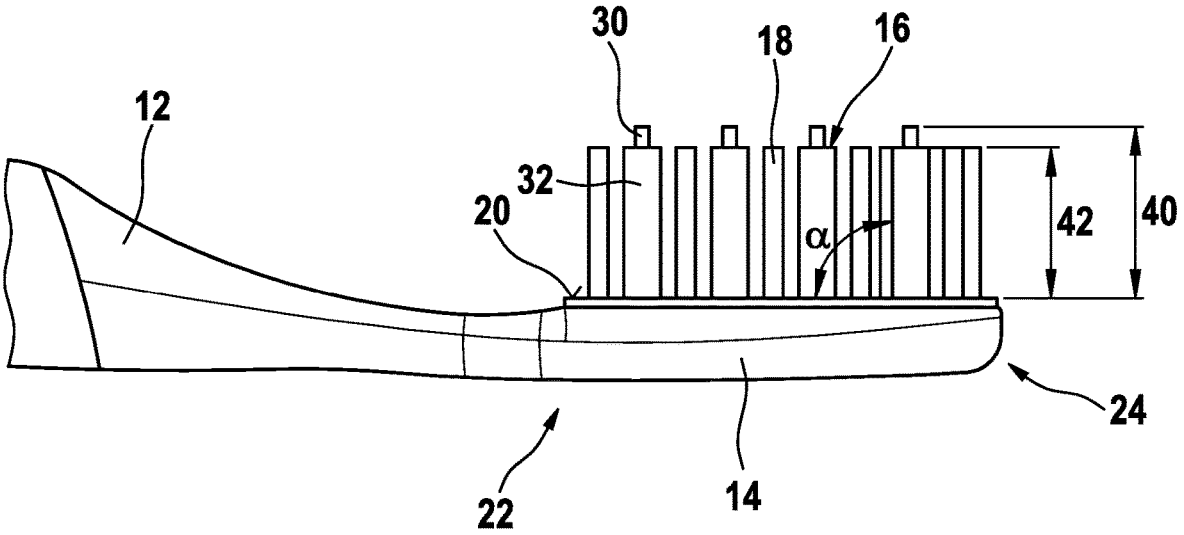
FIG. 2 shows a side view of the oral care implement of FIG. 1.
Figure 3:
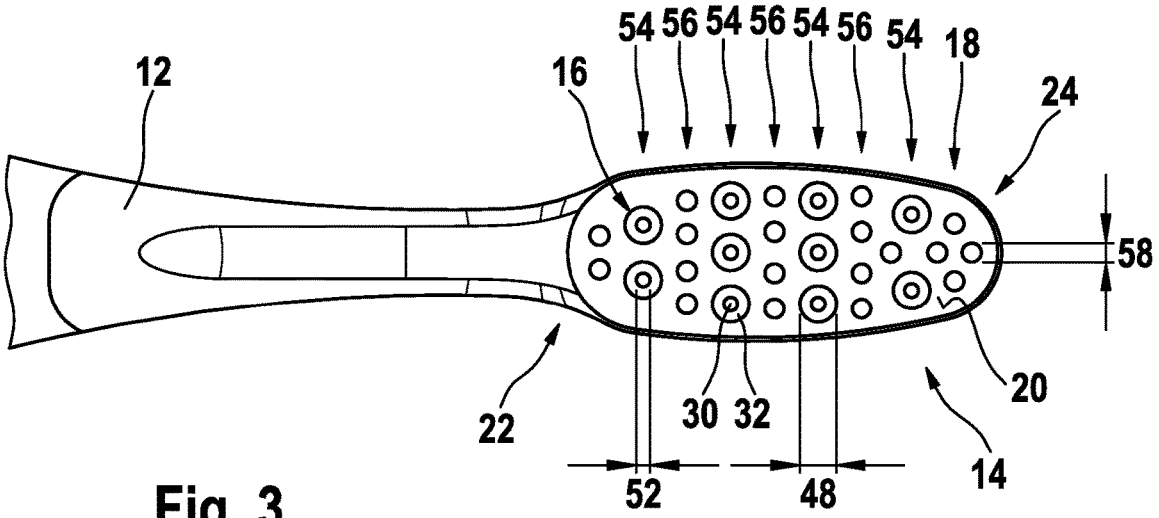
FIG. 3 shows a top down view of the oral care implement of FIG. 1.

FIGS. 1 to 3 show an embodiment of an oral care implement 10, which could be a manual or an electrical toothbrush 10 comprising a handle 12 and a head 14 extending from the handle 12 in a longitudinal direction. The head 14 has a proximal end 22 close to the handle 12 and a distal end 24 furthest away from the handle 12, i.e. opposite the proximal end 22. The head 14 may have substantially the shape of an oval with a length extension 26 and a width extension 28 substantially perpendicular to the length extension 26. Two different types of tufts 16, 18 may be secured to the head 14 by means of a hot tufting process.

The tufts 16, 18 may extend from a mounting surface 20 of the head 14 in a substantially orthogonal manner, i.e. an angle α defined between the tuft 16, 18 and the mounting surface 20 of the head 14 may be about 90°. However, at least one of the tufts 16, 18 may also be inclined with respect to the mounting 20 by an angle α of about 45° to about 89°, optionally from about 60° to about 85°, further optionally from about 65° to about 83°, even further optionally from about 70° to about 80°, even further optionally from about 72° to about 78°, even further optionally about 74°, about 75° or about 76°.

Figure 4:
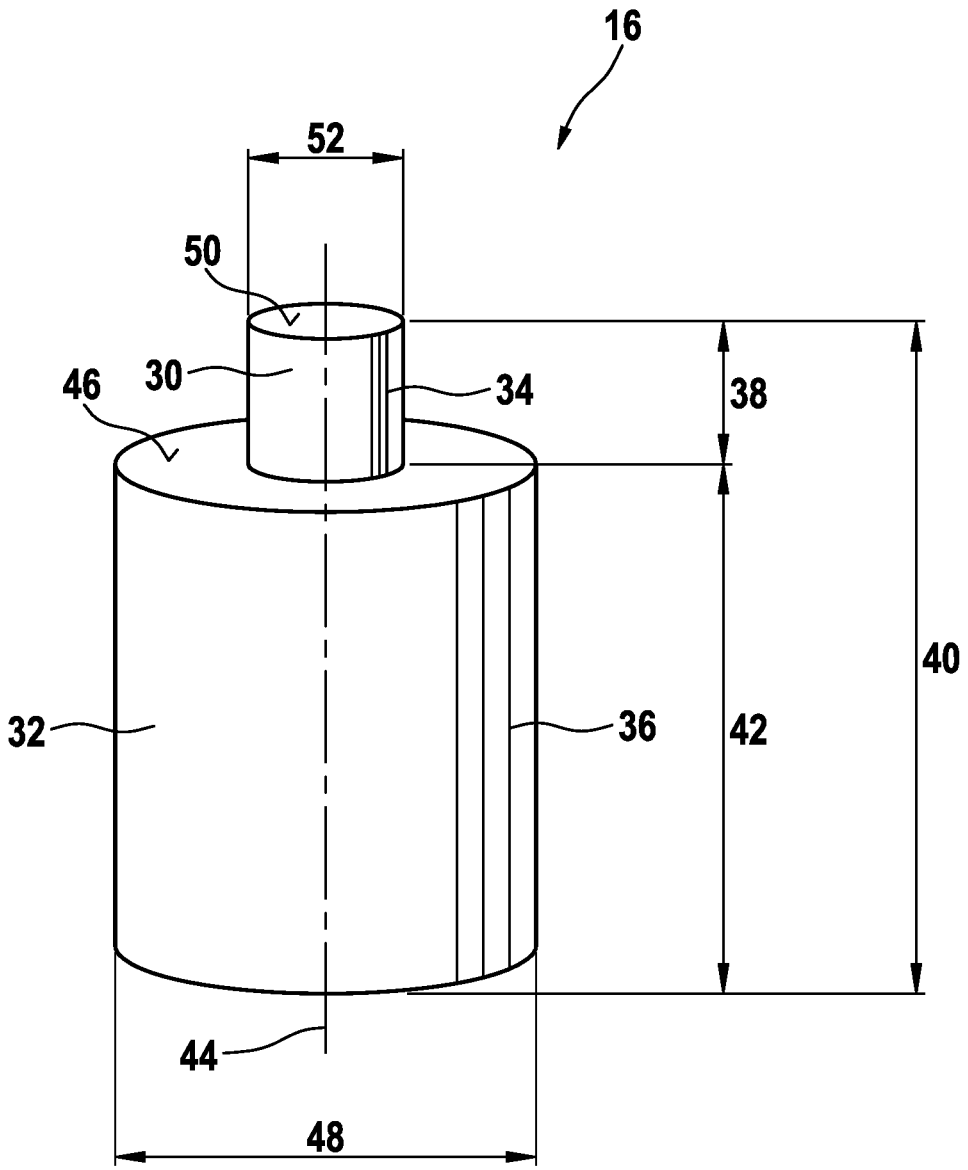
FIG. 4 shows a perspective view of a tuft of the oral care implement of FIG. 1.
Figure 5:
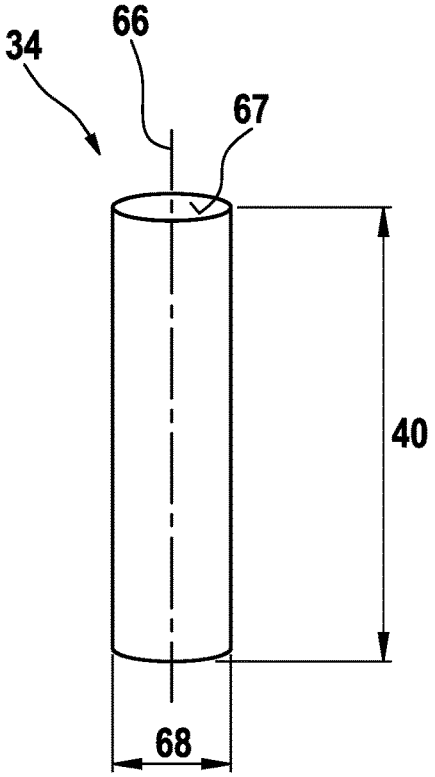
FIG. 5 shows a perspective view of a filament of a first group of the tuft of FIG. 4.
Figure 6:
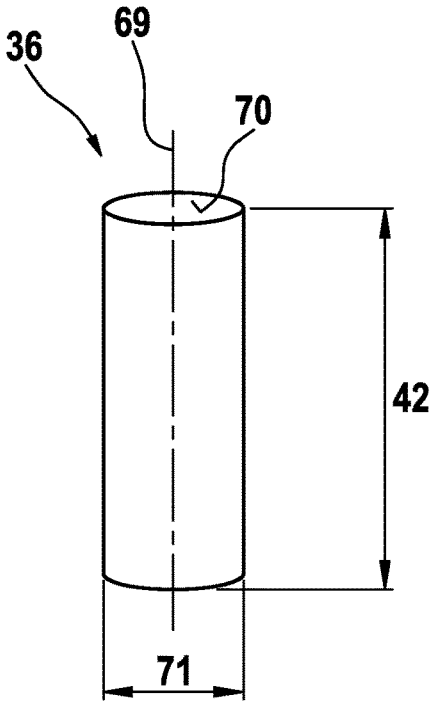
FIG. 6 shows a perspective view of a filament of a second group of the tuft of FIG. 4.

One of the tufts 16 in accordance with the present disclosure is illustrated in FIG. 4. The tuft 16 comprises two different groups 30, 32 of filaments 34, 36, wherein an inner first group 30 is surrounded by an outer second group 32. The first group 30 comprises filaments 34, one of them being shown in FIG. 5, having a longer length 40 compared to the length 42 of the filaments 36, one of them being shown in FIG. 6, of the second group. The difference 38 in length between the filaments 34 of the first group 30 and the filaments 36 of the second group 32 may be about 1.5 mm.

Figure 7:
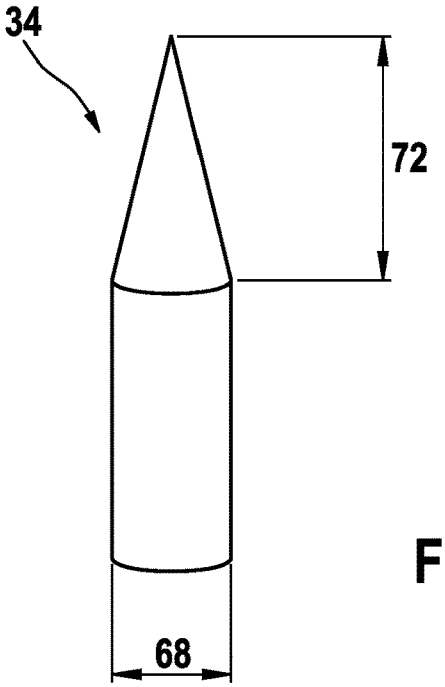
FIG. 7 shows a side view of an alternative embodiment of a filament of the first and/or second group of the tuft of FIG. 4.

Each filament 34, 36 of tuft 16 has a longitudinal axis 66, 69 and a cross-sectional area 67, 70 extending in a plane which is substantially perpendicular to the longitudinal axis 66, 69. The cross sectional area 67, 70 of each filament 34, 36 may have a substantially circular shape wherein the diameter 68 of the filaments 34 of the first group 30 may be smaller than the diameter 71 of the filaments 36 of the second group 32. The diameter 68 of the filaments 34 of the first group 30 may be about 0.15 mm to about 0.16 mm, optionally about 0.1524 mm (6 mil) whereas the diameter 71 of the filaments 36 of the second group 32 may be about 0.17 mm to about 0.18 mm, optionally about 0.1778 mm (7 mil). The filaments 36 of the second group 32 may provide the filaments 34 of the first group 30 with a counterforce during a brushing action and, thus, may provide said filaments 34 with increased stability/bending stiffness which may result in increased contact pressure when the filaments 34 of the first group 30 come into contact with the teeth. The increased contact pressure may force the longer filaments 34 to penetrate more easily into interdental spaces wherein a gentle brushing sensation is provided due to the relatively thin dimensions of the filaments 34. The filaments 34 of the first group 30 may be tapered filaments with a pointed tip 72, as shown in FIG. 7, or substantially cylindrical filaments with end-rounded tips (cf. FIG. 5).

The tuft 16 has a longitudinal axis 44 and a cross-sectional area 46 extending in a plane perpendicular to the longitudinal axis 44. The cross sectional area 46 may have a substantially circular shape with a diameter 48 of about 2.8 mm to about 3.2 mm, optionally of about 3 mm. The first group 30 of filaments 34 may have a cross sectional area 50 with a substantially circular shape having a diameter 52 of about 0.8 mm to about 1.2 mm, optionally of about 1 mm.

Tufts 16 may be arranged in rows 54 which are aligned substantially parallel to the width extension 28 of the head 14. Four rows 54 of tufts 16 may alternate with four rows 56 which comprise tufts 18. Tufts 18 may have a substantially circular cross-sectional shape with a diameter of about 1.7 mm. The tufts 18 may comprise filaments having a substantially circular cross-sectional shape with a diameter of about 0.1778 mm (7 mil). The filaments of tufts 18 may have a length which is equal to the length 42 of the filaments 36 of the second group 32.

In the toe region at the distal end 24 of the head 14, i.e. furthest away from the handle 12, four tufts 18 may be attached to the mounting surface 20 of the head 14. In addition, one tuft 18 may be arranged between row 54 and row 56 which are closest to the distal end 24 of the head 14.

The filaments of tufts 16 and tufts 18 may be made up from a thermoplastic elastomer material (TPE) with or without an abrasive such as kaolin clay, from nylon with or without an abrasive such as kaolin clay, from polybutylene terephtalate (PBT) with or without an abrasive such as kaolin clay or from nylon indicator material colored at the external surface. The filaments 34 of the first group 30 of tufts 16 may be made up of a different material as the filaments 36 of the second group 32.

Comparison Experiments

Robot Tests:

A head for an oral care implement in accordance with the present disclosure (example embodiment 1 of the present disclosure, cf. FIGS. 1 to 6) and a head for an oral care implement according to a comparative example (comparative example 1) were compared with respect to their efficiency of plaque substitute removal on artificial teeth (typodonts).

Example Embodiment 1 of the Present Disclosure

Tuft pattern: cf. FIGS. 1 to 3
Length extension of head 12: 37.5 mm
Tufts 16 (cf. FIGS. 4 to 6):
Cross-sectional shape of tuft 16: circular
Diameter 48 of tuft 16: 3 mm
Length 40 of filaments 34 of first group 30: 12.5 mm
Cross-sectional shape of filaments 34 of first group 30: circular
Diameter 68 of filaments 34 of first group 30: 0.1524 mm (6 mil)
Diameter 52 of first group 30: 1 mm
Length 42 of filaments 36 of second group 32: 11 mm
Cross-sectional shape of filaments 36 of second group 32: circular
Diameter 71 of filaments 36 of second group 32: 0.1778 mm (7 mil)
Tufts 18:
Cross-sectional shape of tuft 18: circular
Diameter 58 of tuft 18: 1.7 mm
Length of filaments: 11 mm
Cross-sectional shape of filaments: circular
Diameter of filaments: 0.1778 mm (7 mil)
Material of all filaments: Nylon PA6.12

Comparative Example 1

Length extension of the head: 37.5 mm
Tuft pattern: 10 rows comprising the following number of tufts:
$1^{st}$ row (at the proximal end of the head): 2 tufts
$2^{nd}$ row: 3 tufts
$3^{rd}$ row: 3 tufts
$4^{th}$ row: 4 tufts $5^{th}$ row: 4 tufts
$6^{th}$ row: 4 tufts
$7^{th}$ row: 4 tufts
$8^{th}$ row: 3 tufts
$9^{th}$ row: 2 tufts
$10^{th}$ row (at the distal end of the head): 1 tuft
Cross-sectional shape of tufts: circular
Diameter of tufts: 1.7 mm
Cross-sectional shape of the filaments of tufts: circular
Diameter of the filaments of tufts: 0.1778 mm (7 mil)
Length of the filaments of tufts: 11 mm
Material of all filaments: Nylon PA6.12

Brushing tests were performed using a robot system KUKA 3 under the following conditions (cf. Table 1):

TABLE 1

| Product | program upper jaw | program lower jaw | force | power supply |
|---|---|---|---|---|
| All tested products | EO_INDI | EU_INDI | 3 N | no |
| total cleaning time | 60 s | 60 s | | |
| program version | 9.11.09 Eng | 9.11.09 Eng | | |
| SYSTEC speed | 60 | 60 | | |
| SYSTEC amplitude x/y | 20/0 | 20/0 | | |
| number of moves | 3 | 3 | | |
| Movement | | horizontal | | |
| used handle/mould | | No/no | | |

Figure 8:
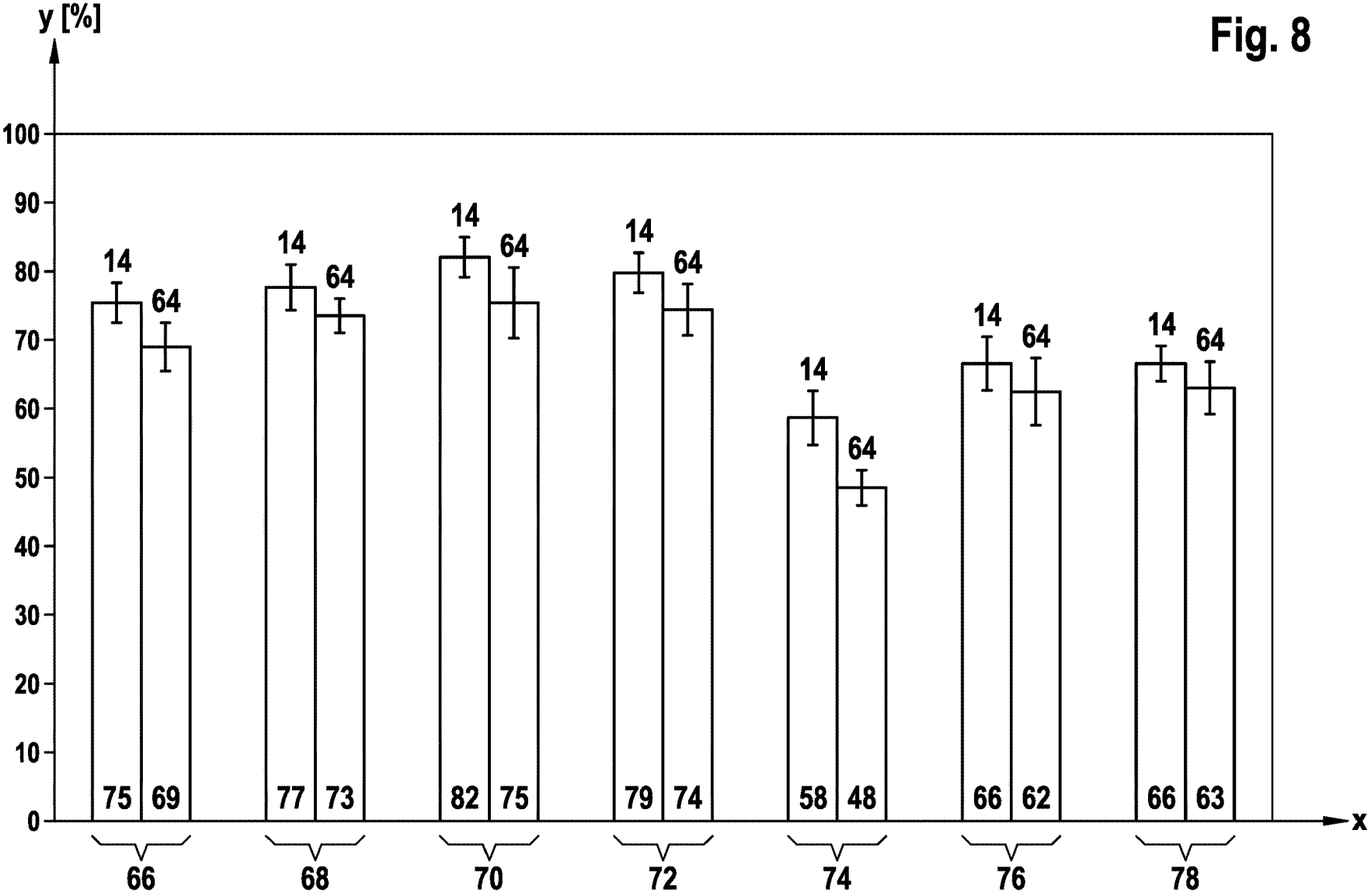
FIG. 8 shows a diagram in which brushing results of an oral care implement according to an embodiment of the present disclosure are compared with brushing results of a comparative example embodiment.

FIG. 8 shows the amount of plaque substitute removal in % of the example embodiment 1 (14) and the comparative example 1 (64), each with respect to all tooth surfaces (66), buccal surfaces (68), lingual surfaces (70), lingual and buccal surfaces (72), occlusal surfaces (74), the gum line (76) and interdental surfaces (78).

FIG. 8 clearly shows that example embodiment 1 (14) provides significant improved plaque removal properties with respect to all tooth surfaces (66), buccal surfaces (68), lingual surfaces (70), lingual and buccal surfaces (72), occlusal surfaces (74), the gum line (76) and interdental surfaces (78) compared to comparative example 1 (64).

Sensory Tests:

Further, sensory tests showed performance advantages of oral care implements according to the present disclosure (example embodiments 1 and 2) as compared to care oral implements according to an comparative example (comparative example 2). Sensory tests enable trained and experienced panelists to evaluate the effects of oral care implements in comparison with a defined standard. The sensory tests, i.e. sensorial evaluation of different tuft shapes without usage of toothpaste were carried out by 5 trained and experienced sensory experts for the following criteria: interdental cleaning, overall in-mouth perception, stiffness and stability of the tuft pattern. The evaluation of example embodiments 1 and 2 and comparative example 2 was as follows:

Example Embodiment 1 of the Present Disclosure as Described Above

Sensorial Evaluation:
Overall cleaning was very good.
The interdental cleaning perception was very good for the majority of panelists.
The brush was perceived as a high efficiency tool having a stable bristle field.
With more pressure, example embodiment 1 was still stable and the bristles were not bending away resulting in good interdental cleaning perception.
Perfect setup.

Example Embodiment 2 of the Present Disclosure as Described Above, However with Four Rows Arranged Next to Each Other Sensorial Evaluation:
The brush is very soft and gentle on gums.
The higher tufts penetrate between teeth and are flexible enough to allow the lower tufts to have a lot of bristle contact on teeth.
Interdental penetration is high.
Perfect setup.

Comparative Example 2

Pattern of tufts comprising filaments of different length (longer filaments in inner group and shorter filaments in outer group): 4 rows arranged next to each other, each row having three tufts
Cross-sectional shape of tufts: circular
Diameter of tufts: 3 mm
Length of filaments of inner group: 13.5 mm
Diameter of inner group: 1 mm
Cross-sectional shape of filaments of inner group: circular
Diameter of filaments of inner group: 0.1778 mm (7 mil)
Length of filaments of outer group: 11 mm
Cross-sectional shape of filaments of outer group: circular
Diameter of filaments of outer group: 0.1778 mm (7 mil)
Material of all filaments: Nylon PA6.12

Sensorial Evaluation:
Sometimes the bristles are slightly poky on gums, especially when using circular brushing movements.
There is not much overall bristles contact, because most contact is only with the higher bristles.
Inner group of bristles is too long.

The sensory test results clearly show that a difference in filament length of about 2.5 mm leads to less overall filament contact as most filament contact occurs only with the longer filaments. Further, a difference in filament length of about 2.5 mm results in a slightly poky perception. In contrast thereto, a difference in length of about 1.5 mm leads to both, a soft and gentle perception on gums and to a good interdental penetration of the longer filaments. Further, the longer filaments are flexible enough to allow the shorter filaments to have sufficient contact with the teeth.

In the context of this disclosure, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A head for an oral care implement comprising:

a mounting surface, at least one first tuft extending from the mounting surface, the at least one first tuft comprising a first group of filaments and a second group of filaments, the first group of filaments being surrounded by the second group of filaments, wherein each filament of the at least one first tuft has a longitudinal axis and a cross-sectional area extending in a plane perpendicular to the longitudinal axis, and the cross-sectional area has a substantially circular shape, and the filaments of the first group of filaments have a first diameter being smaller than a second diameter of the second group of filaments, the first group of filaments having a first length and the second group of filaments having a second length, the first length being longer than the second length, wherein a difference in length between the first length and the second length is from about 1.1 mm to 1.9 mm; and at least one second tuft extending from the mounting surface, wherein the at least one second tuft comprises a third group of filaments, the third group of filaments having a third length, wherein the head comprises a first region comprising alternating rows of first tufts and second tufts.

2. A head according to claim 1, wherein the difference in length between the first length and the second length is about 1.3 mm to about 1.7 mm.

3. A head according to claim 2, wherein the difference in length between the first length and the second length is about 1.5 mm.

4. A head according to claim 1, wherein the first diameter is about 0.15 mm to about 0.16 mm.

5. A head according to claim 1, wherein the second diameter is about 0.17 mm to about 0.18 mm.

6. A head according to claim 1, wherein the at least one first tuft has a longitudinal axis and a cross-sectional area extending in a plane perpendicular to the longitudinal axis, and the cross-sectional area has a substantially circular shape with a diameter of about 2.8 mm to about 3.2 mm.

7. A head according to claim 1, wherein the first group of filaments has a longitudinal axis and a cross-sectional area extending in a plane perpendicular to the longitudinal axis, and the cross-sectional area of the first group of filaments has a substantially circular shape with a diameter of about 0.8 mm to about 1.2 mm.

8. A head according to claim 1, wherein the filaments of the first group of filaments are tapered filaments having a pointed tip.

9. A head according to claim 1, wherein the filaments of the first group of filaments and the filaments of the second group of filaments further differ from each other at least in one of the following characteristics: bending stiffness, material, texture, cross sectional shape, color and combinations thereof.

10. A head according to claim 1, wherein the at least one first tuft is inclined with respect to the mounting surface of the head.

11. A head according to claim 10, wherein an angle ($\alpha$) defined between the at least one first tuft and the mounting surface of the head is about 45° to about 89°.

12. A head according to claim 1, wherein the at least one first tuft is attached to the head by means of a hot-tufting process.

13. A head according to claim 1, wherein the third length of the third group of filaments is equal to the second length of the second group of filaments.

14. A head according to claim 1, wherein the alternating rows in the first region are aligned substantially parallel to a width extension of the head.

15. A head according to claim 1, wherein the head further comprises a second region that comprises the at least one second tuft.

16. A head according to claim 1, wherein the head comprises a toe region at a distal end of the head, wherein the toe region comprises one or both of the at least one first tuft and the at least one second tuft.

17. A head according to claim 16, wherein the toe region comprises the at least one second tuft.

18. A head according to claim 16, wherein the toe region comprises four of the at least one second tuft.

19. An oral care implement comprising a head according to claim 1.

* * * * *